US008387988B2

(12) United States Patent
Van Ness

(10) Patent No.: US 8,387,988 B2
(45) Date of Patent: Mar. 5, 2013

(54) PATTERN BUILDING GAME ASSEMBLY WITH LAUNCHING APPARATUS AND METHODS

(75) Inventor: Craig Steven Van Ness, Wilbraham, MA (US)

(73) Assignee: Hasbro, Inc., Pawtucket, RI (US)

( * ) Notice: Subject to any disclaimer, the term of this patent is extended or adjusted under 35 U.S.C. 154(b) by 210 days.

(21) Appl. No.: 12/881,289

(22) Filed: Sep. 14, 2010

(65) Prior Publication Data

US 2012/0061918 A1 Mar. 15, 2012

(51) Int. Cl.
*A63B 63/00* (2006.01)
*A63F 3/02* (2006.01)

(52) U.S. Cl. ..... 273/357; 273/261; 273/399

(58) Field of Classification Search ..... 273/355–357, 273/398–402, 260, 261
See application file for complete search history.

(56) References Cited

U.S. PATENT DOCUMENTS

| | | | | | |
|---|---|---|---|---|---|
| 817,928 | A * | 4/1906 | Medley | 124/7 |
| 1,168,854 | A | 1/1916 | Chase | |
| 1,279,654 | A * | 9/1918 | Charlesworth | 273/399 |
| 2,432,824 | A | 12/1947 | Shetler | |
| 3,399,895 | A * | 9/1968 | Beach | 273/241 |
| 3,434,719 | A * | 3/1969 | Fyanes | 273/260 |
| 3,601,402 | A * | 8/1971 | Kohner et al. | 273/399 |
| 3,675,924 | A | 7/1972 | Smith | |
| 3,787,053 | A * | 1/1974 | Breslow | 273/356 |
| 3,794,325 | A * | 2/1974 | Stender | 273/399 |
| 4,243,227 | A | 1/1981 | Strongin | |
| 4,582,326 | A | 4/1986 | Alsip | |
| 4,651,996 | A | 3/1987 | Watkins, Jr. | |
| 5,085,440 | A * | 2/1992 | Van Dam | 273/241 |
| 5,277,419 | A | 1/1994 | Craig | |
| 5,318,307 | A * | 6/1994 | Bouchard et al. | 273/348.4 |
| 5,435,570 | A | 7/1995 | Labrasseur | |
| 5,613,681 | A | 3/1997 | Allen | |
| 6,276,685 | B1 * | 8/2001 | Sterling | 273/241 |
| 6,543,772 | B1 * | 4/2003 | Bourdow | 273/260 |

* cited by examiner

*Primary Examiner* — Mark Graham
(74) *Attorney, Agent, or Firm* — Perry Hoffman

(57) ABSTRACT

A game apparatus and a method using trays as the game board with vertical support columns, two sets of playing pieces and two launching devices. The one or more vertical support columns attach to the one or more trays to support the trays horizontally above a support surface. On the surface of each of the trays is a matrix and each element of the matrix has a recessed compartment orthogonal to the surface of the tray. Each recessed compartment is sized to hold a multiplicity of both types of playing pieces in a stacked manner. The launching devices are used to launch the playing pieces from the launching devices into the recessed compartments on the trays. Games are played with two or more players and the object of the game is for one player to be the first to build a predetermined pattern.

20 Claims, 15 Drawing Sheets

PATTERN BUILDING GAME ASSEMBLY WITH LAUNCHING APPARATUS AND METHODS

FIELD OF THE INVENTION

The present invention relates generally to a game assembly, and more particularly to a board game that involves pattern building for competition between two or more players using launching devices to launch playing pieces into recessed compartments at multiple levels on the game board.

BACKGROUND OF THE INVENTION

For centuries, board games have been an extremely popular form of entertainment for people of all ages. One category of popular board games involves one player trying to build predetermined patterns on the game board with playing markers before one's opponent builds the desired pattern. Well known games in this genre include Pente, gomoku and renju. Also, since 1974, the genre of pattern building games has included the very popular game of Connect Four™, a game published by Milton Bradley™. A much older version of Connect Four™ is known as The Captain's Mistress. These games relate to games of skill involving a competition between two or more players to build a desired pattern on the game board while preventing other players from building the desired pattern. All these games are played in a two-dimensional space.

Another category of popular board games involves games played in a three-dimensional space. For example, variations of three-dimensional chess have existed since the late nineteenth century, and one of the oldest versions is Raumschach, invented in 1907 by Ferdinand Maack. Another version of three-dimensional chess has also often appeared on the popular television show Star Trek. Additionally, U.S. Pat. No. 3,656,755, issued to Thompson, for "Three-Dimensional Checker Game Apparatus" discloses a three-dimensional variation of checkers played on five pentagonal, vertically spaced game boards.

The prior art includes pattern building games that build patterns in a three-dimensional space. The game Qubic™ is the brand name of a four-in-a-row tic-tac-toe type game played in a 4×4×4 matrix and sold by Parker Brothers™ starting in 1953, and Milton Bradley's™ Score Four™, which involves building patterns of beads by stacking the beads on spindles. Furthermore, a few patents in the prior art disclose structures adapted to enable players to assemble game pieces on several different spaced parallel planes. U.S. Pat. No. 5,277,419, issued to Craig, for "Method of Playing a Three Dimensional Game" discloses a method for playing a tic-tac-toe type game on a 3×3×3 board configuration for multiple players using distinguishable sets of playing pieces for each player that can be played on any position on the board configuration and one marked playing piece per player that can only be played on the center position of each board. Also, U.S. Pat. No. 5,613,681, issued to Allen, for "Strategy Game With Two Or Three Dimensional Matrix And Balls" discloses another tic-tac-toe type game using a lattice type matrix forming a plurality of interconnected adjacent open cubes and spherical playing pieces to form patterns within the lattice where pushing the spherical playing pieces into the lattice can move playing pieces from one position in the lattice to another position in the lattice.

A third category of popular board games involves games where playing pieces are launched onto a game board with the objective of either landing the playing pieces on the board in a certain manner or landing the playing pieces on certain areas of the board to achieve a certain score. U.S. Pat. No. 2,432,824, issued to Shetler, for a "Game Apparatus" discloses a game that simulates the games of horse shoes, ring toss, and shuffle board by launching playing pieces from each end of a single-planed game board onto a scoring area. U.S. Pat. No. 3,675,924, issued to Smith, for "Projection Game Apparatus Including Paper Clip Projector And Closely Spaced Target Posts" discloses a game apparatus for projecting lightweight planar objects using a paper clip toward a plurality of spaced posts for individually ringing posts, leaning against one or several posts, or being suspended against gravity upon the plateau-like tops of two or more posts, the game board existing in a single plane. U.S. Pat. No. 5,435,570, issued to Labrasseur, for "Game Apparatus With Launching Device And Method Of Playing" discloses a game where projectiles are launched onto circuitous, closed-end, loop-shaped landing sites attached to columnar bases attached to the floor of a target housing with score indicators on the landing sites. The described embodiment simulates frogs jumping onto lily pads where the difficulty of landing on a particular lily pad is reflected in the score on the pad.

The concept of launching playing markers into a game board to achieve a desired pattern is also known in the prior art. U.S. Pat. No. 4,243,227, issued to Strongin, for "Disc Projecting Game" discloses an action toy game wherein players launch game pieces through an upwardly-arched arcuate guide channel with the goal of landing the game pieces into a vertically supported hollow display section with a plurality of vertical compartments and with the further goal of achieving a certain pattern within the vertical compartments.

A disadvantage of the prior art is that it does not allow for a variety of games within embodiments where some games have the characteristics of a competitive sport where players act simultaneously and other games that involve intellectual strategy and skilled coordination in alternating turns.

Accordingly, it would be desirable to have a pattern building board game wherein the desired patterns are achieved by launching playing pieces onto multiple levels of trays or game boards in three dimensions, where each tray or game board is a matrix of recessed compartments. These arrangements allow games where a single playing area is shared by multiple players so that game play can include simultaneous launching and alternate launching and control of the recessed compartments can be defined by either the topmost playing piece in a compartment of the number playing pieces belonging to each player in each compartment. Such inventions allow for games that employ a combination of sport and intellectual strategy with a variation in the amount of sport versus intellectual strategy that may be utilized in the various games. For example, games with simultaneous launching into a single playing surface will have greater characteristics of a sport whereas games with alternate launching will have greater characteristics of an intellectual strategy game.

The inventions discussed in connection with the described embodiments address these and other deficiencies of the prior art. The features and advantages of the present inventions will be explained in or apparent from the following description of the preferred embodiments considered together with the accompanying drawings.

SUMMARY OF THE INVENTION

The present inventions address the deficiencies of the prior art of pattern building board games played in a three-dimensional space by adding elements that increase the number of types of games that can be played and the variety with which those games are played. Particularly, a launching feature is added that allows the pattern building games to be played with the characteristics of a competitive sport as well as with the characteristics of games involving intellectual strategy and skilled coordination at varying levels where multiple players act simultaneously or in alternating turns. Consequently, in comparison to the prior art, the variety of the types of games that can be played and the level of enjoyment are increased.

Described embodiments of the invention provide a game apparatus that includes a game board in the form of a tray. A vertical support column is attachable to the tray to support the tray horizontally above a support surface. A set of first playing pieces and a set of second playing pieces, distinguishable from the first set of playing pieces, are used for building patterns on the tray. The tray is in the form of a matrix created on the surface of the tray where each element of the matrix is a recessed compartment orthogonal to the surface of the tray. Each recessed compartment is sized to hold a multiplicity of first playing pieces and a multiplicity of second playing pieces simultaneously in a stacked manner. A first launching device and a second launching device are used to launch first playing pieces and second playing pieces respectively into the recessed compartments.

During game play, players use the launching devices to launch the playing pieces into the recessed compartments. A player wins a game when a desired pattern is achieved with the playing pieces in the recessed compartments. Games can be played where players launch playing pieces simultaneously, which increases the characteristics of a competitive sport and lessens the characteristics of an intellectual strategy game, or where players launch playing pieces in alternating turns, which lessens the characteristics of a competitive sport and increases the characteristics of an intellectual strategy game.

The game apparatus can be enhanced to use a plurality of vertical support columns to support the tray. The game apparatus can also be enhanced to use a plurality of trays, where each tray is attached to either one vertical support column or multiple vertical support columns. Each of the plurality of trays is in the form of a matrix where each element of the matrix is a recessed compartment orthogonal to the surface of the tray and where each recessed compartment is sized to hold a multiplicity of first playing pieces and a multiplicity of second playing pieces simultaneously in a stacked manner.

To facilitate launching first playing pieces at varying angles and varying distances, so that a player may more easily and skillfully launch first playing pieces and second playing pieces into any recessed compartment in any of a plurality of trays, the first launching device and the second launching device may each have a plurality of planar surfaces on its underside arranged such that each of said planar surfaces is at an angle to every other of said planar surfaces. Thus, the playing pieces may be launched at different angles and different distances for each of the planar surfaces when they are placed on a horizontal support surface.

Described embodiments is further enhanced over the prior art when the recessed compartments are created so that the number of first playing pieces in each recessed compartment and the number of second playing pieces in each recessed compartment and the order in which said first playing pieces and said second playing pieces are stacked within each recessed compartment is observable. This way, the number of each type of playing piece and the order of each type of playing piece can be a factor in how a game is played and won.

In certain embodiments, various indicia are placed on the first playing pieces and the second playing pieces to enhance and to increase the variety of game play when games are played using an alternating turn format. A first indicia is placed on first playing pieces and on second playing pieces so that when a first player or a second player respectively launches a first playing piece or a second playing piece with the first indicia into a recessed compartment, the player that launched the playing piece with the first indicia takes another turn.

A second indicia is placed on first playing pieces and on second playing pieces so that when a first player or a second player respectively launches a first playing piece or a second playing piece with the second indicia into a recessed compartment, the player that launched the playing piece with the second indicia removes all first playing pieces and all second playing pieces from all recessed compartments adjacent to the recessed compartment in which the playing piece with the second indicia landed.

A third indicia is placed on first playing pieces and on second playing pieces so that when a first player or a second player respectively launches a first playing piece or a second playing piece with the third indicia into a recessed compartment, the player that launched the playing piece with the third indicia removes all first playing pieces and all second playing pieces from all other recessed compartments in either a row or a column in which the playing piece with the third indicia was launched.

Lastly, a fourth indicia is placed on first playing pieces and on second playing pieces so that when a first player or a second player respectively launches a first playing piece or a second playing piece with the fourth indicia into a recessed compartment, the player that launched the playing piece with the fourth indicia removes all first playing pieces and all second playing pieces from any one recessed compartment adjacent to the recessed compartment in which the playing piece with the fourth indicia landed.

BRIEF DESCRIPTION OF THE DRAWINGS

The inventions will now be more particularly described by way of example with reference to the accompanying drawings. Novel features believed characteristic of the inventions are set forth in the claims. The inventions themselves, as well as the preferred mode of use, further objectives, and advantages thereof, are best understood by reference to the following detailed description of the embodiments in conjunction with the accompanying drawings, in which:

DETAILED DESCRIPTION OF THE EMBODIMENTS

The described embodiments reveal a game apparatus and a method for playing the game. The game apparatus comprises one or more trays used for the game board, one or more vertical support columns, two sets of playing pieces and two launching devices. The one or more vertical support columns attach to the one or more trays to support the trays horizontally above a support surface. On the surface of each of the trays is a matrix wherein each element of the matrix comprises a recessed compartment orthogonal to the surface of the tray and wherein each recessed compartment is sized to hold a multiplicity of both types of playing pieces in a stacked manner. The launching devices are used to launch the playing pieces from the launching devices into the recessed compartments on the trays. Games are played with two or more players. The object of the game is for one player to be the first player to build a predetermined pattern with the playing pieces in the recessed compartments by launching the playing pieces into the recessed compartments. The recessed compartments may also be created so that the order and the number of the playing pieces within each recessed compartment are observable, thus adding further variety in game play.

Figure 1:
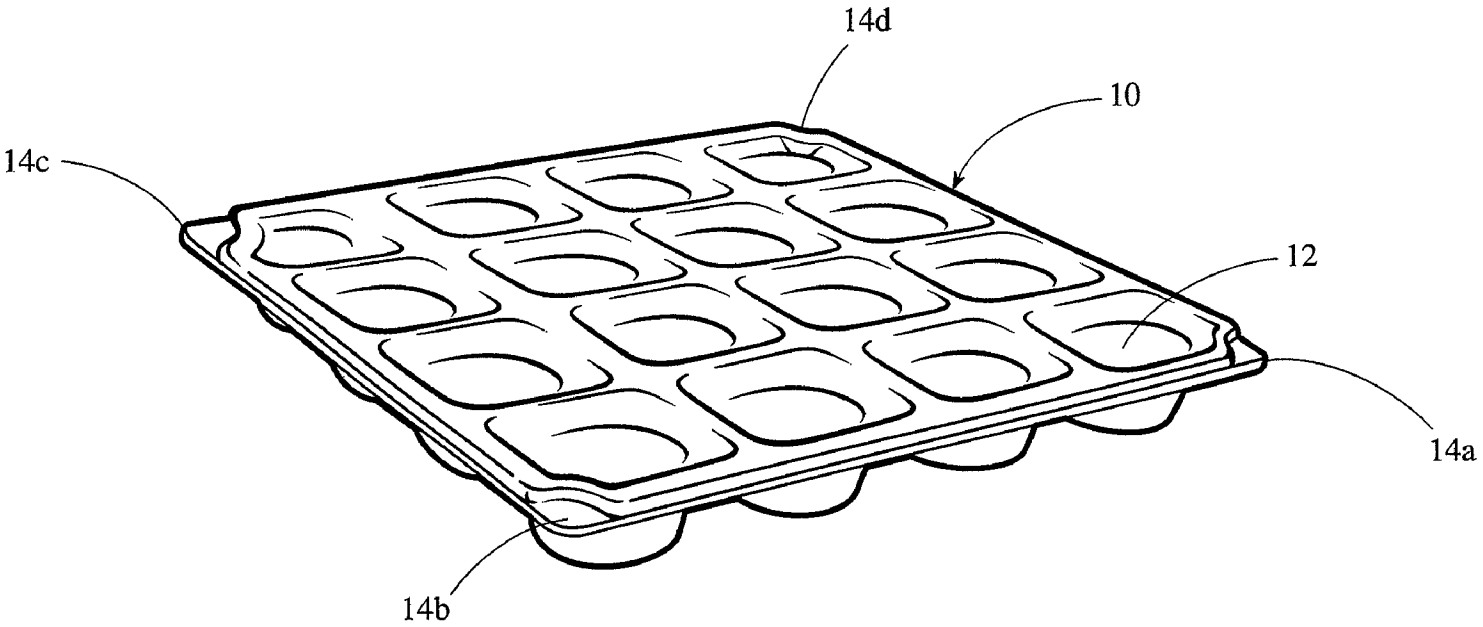
FIG. 1 shows a perspective view of the game board tray.
Figure 2:
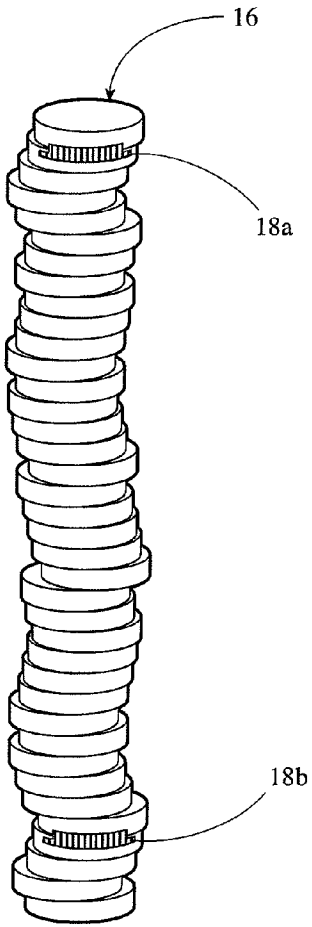
FIG. 2 shows a plan view of a vertical support column.

FIG. 1 shows a perspective view of the game board tray 10. The game board tray 10 displays a matrix on the surface of the tray wherein each element of the matrix comprises a recessed compartment 12 orthogonal to the surface of the tray 10. The corners of the game board tray 10 have attachment lips 14*a*-14*d* that can be used to attach the game board tray 10 to a support that will support the game board tray 10 over a horizontal support surface. FIG. 2 shows a plan view of a vertical support column 16 that attaches to the game board tray 10 and supports the game board tray 10 over a horizontal support surface by inserting one of the attachment lips 14*a*-14*d* as shown in FIG. 1 into either an upper attachment groove 18*a* or a lower attachment groove 18*b*.

Figure 3A:
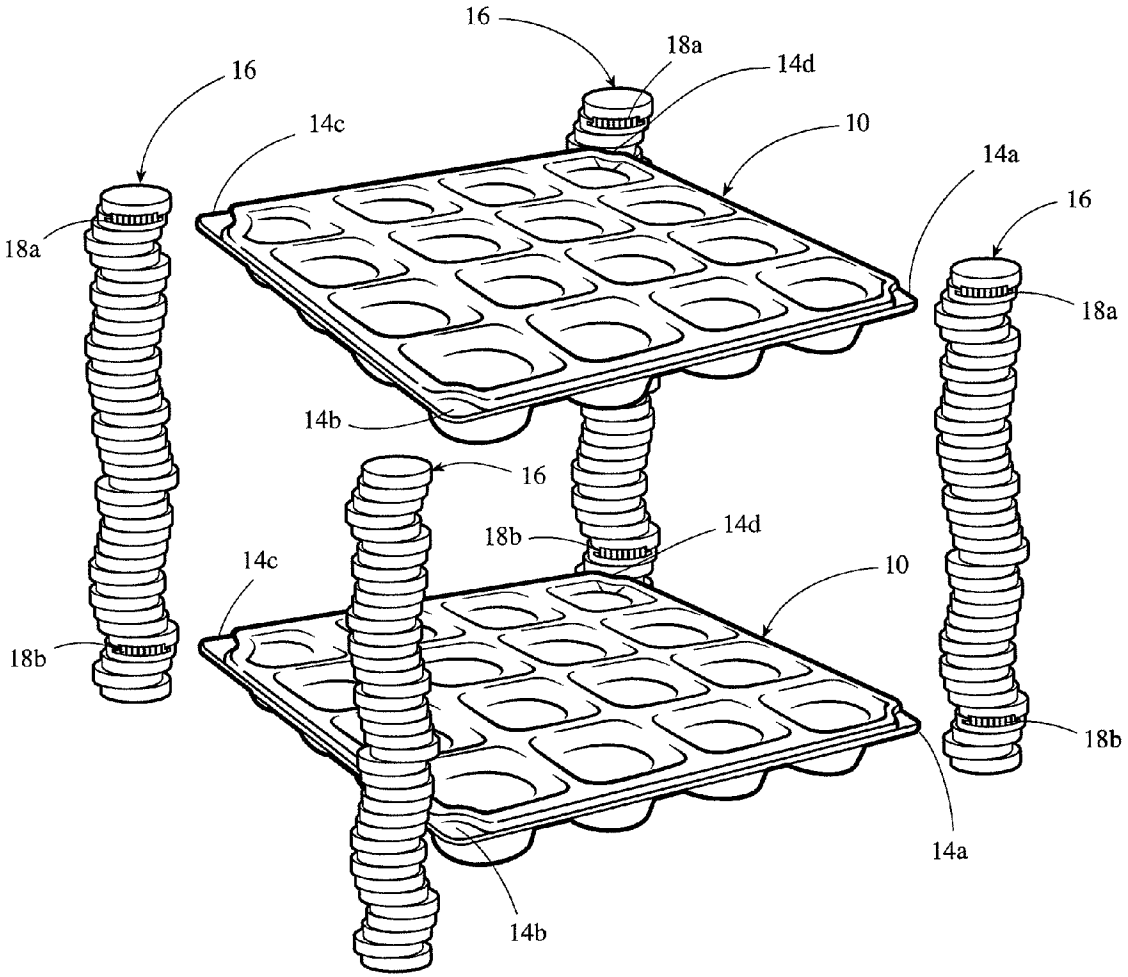
FIG. 3A shows a perspective view of multiple game board trays and multiple vertical support columns aligned for assembly.
Figure 3B:
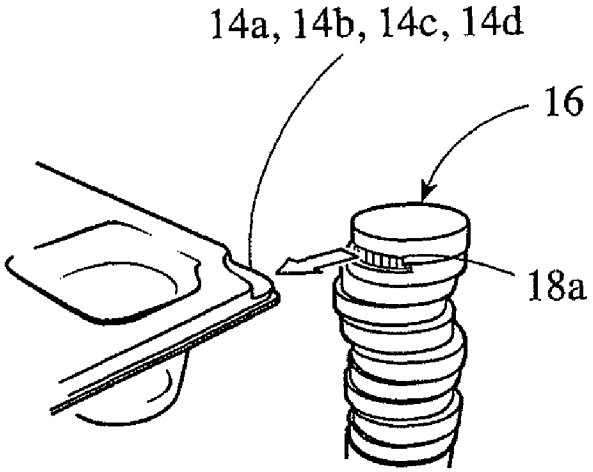
FIG. 3B and FIG. 3C show how game board trays are attached to the top and to the bottom of a vertical support column, respectively.
Figure 3C:
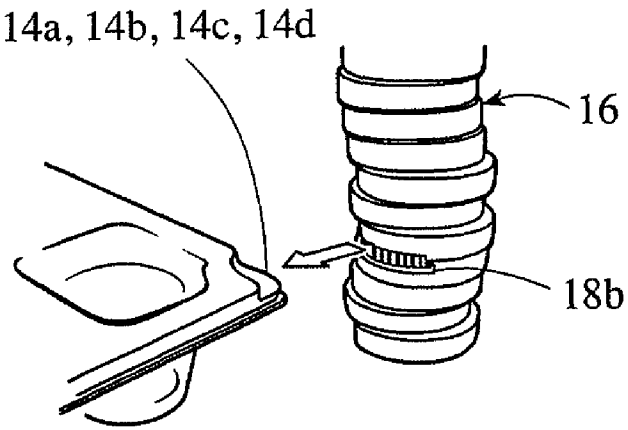

FIG. 3A shows how a multiplicity of vertical support columns 16 can be aligned with a multiplicity of game board trays 10 to form the game apparatus in a three dimensional space. The upper attachment grooves 18*a* and the lower attachment grooves 18*b* of the vertical support columns 16 are aligned with the attachment lips 14*a*-14*d* of the vertical support columns 16 for assembly. FIG. 3B shows how an attachment lip 14*a*-14*d* of the game board tray 10 is attached to the upper attachment groove 18*a* of the vertical support column 16 to support the game board tray 10 horizontally above a support surface. FIG. 3C shows how an attachment lip 14*a*-14*d* of the game board tray 10 is attached to the lower attachment groove 18*b* of the vertical support column 16 to support the game board tray 10 horizontally above a support surface.

Figure 4B:
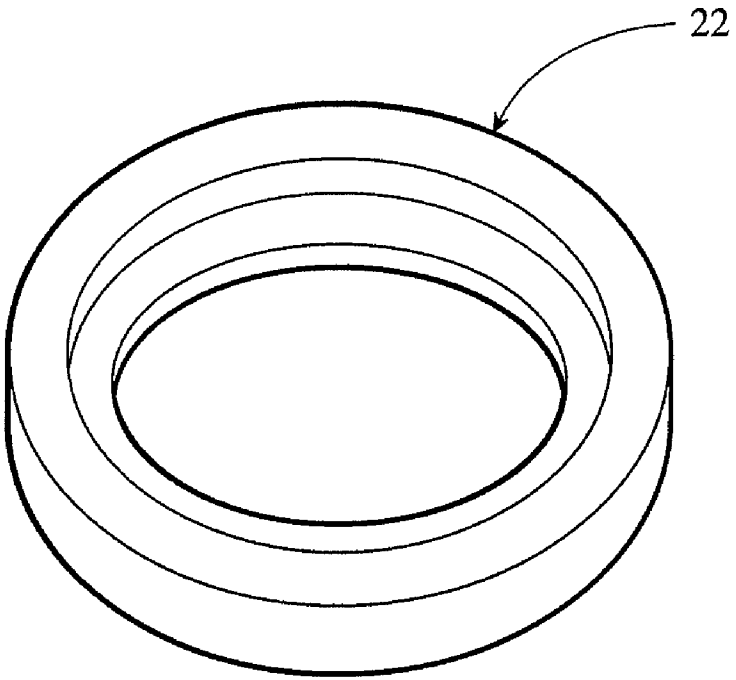
FIG. 4A and FIG. 4B show an example of a first playing piece and a second playing piece, respectively.
Figure 4A:
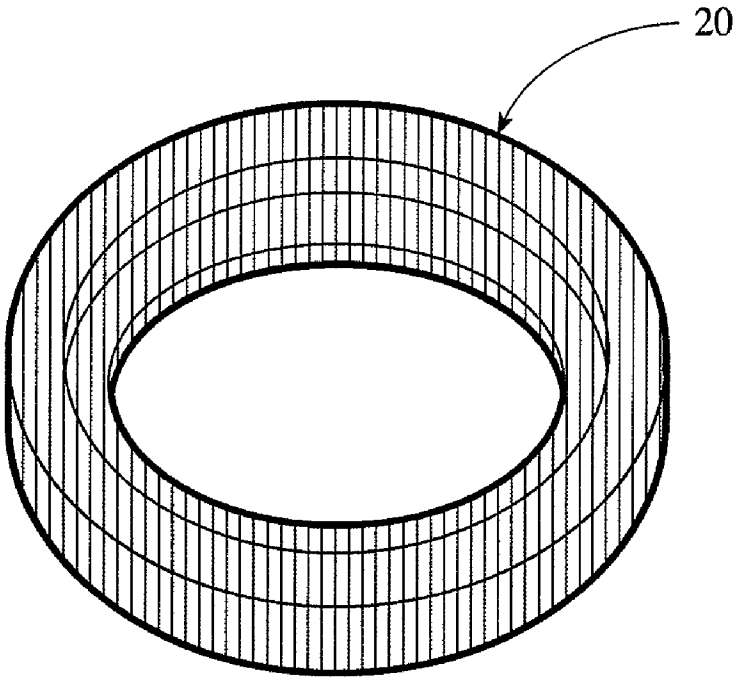
Figure 5B:
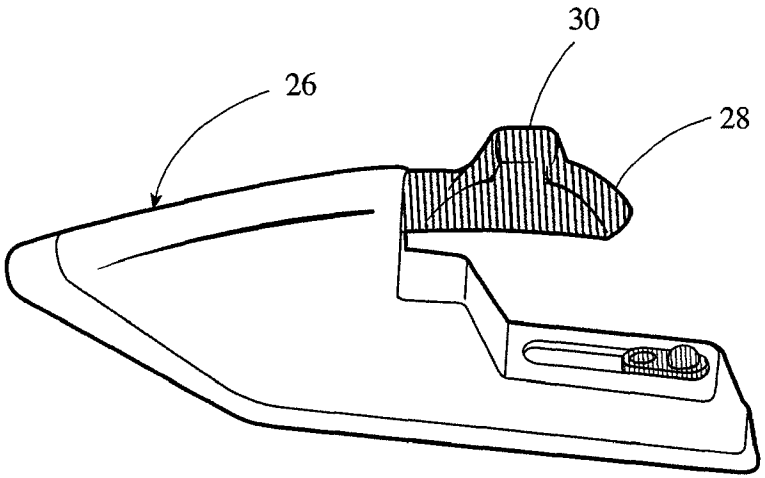
FIG. 5A and FIG. 5B show a first launching device and a second launching device, respectively.
Figure 5A:
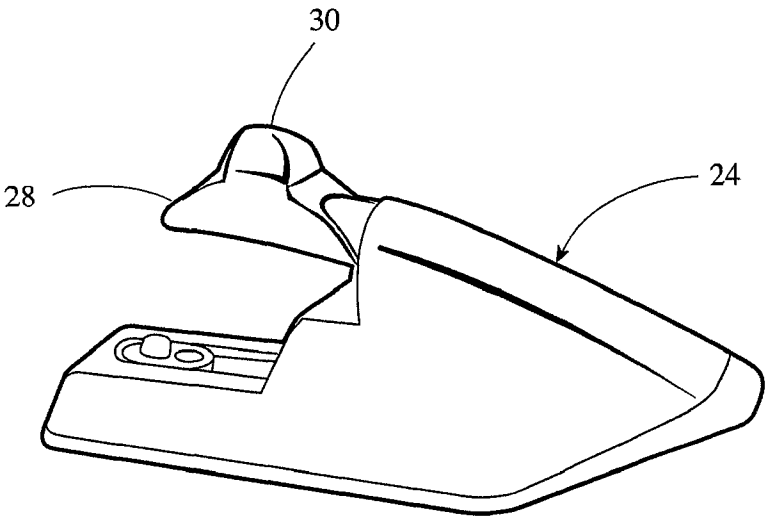

FIG. 4A and FIG. 4B show a first playing piece 20 and a second playing piece 22, respectively, wherein the first playing piece 20 and the second playing piece are distinguishable. These playing pieces are shown as distinguishably identifiable playing pieces so that each type of playing piece may be associated with a different player. Playing pieces in the described embodiments are generally distinguished by color, although other distinguishable indicia may be used. FIG. 5A shows a first launching device 24 and FIG. 5B shows a second launching device 26 to be used by a first player and a second player respectively during game play. In the described embodiments, both the first launching device 24 and the second launching device 26 have a spring-tensioned lever 28 that is used to launch first playing pieces 20 and second playing pieces 22 into the recessed compartments 12 of the game board tray 10 during game play. The spring-tensioned lever 28 features a playing piece mount 30 that is used to secure a first playing piece 20 and a second playing piece 22 on the spring-tensioned lever 28 before either the first playing piece 20 or the second playing piece 22 is launched. In order to launch a first playing piece 20 or a second playing piece 22, a player must place either a first playing piece 20 or a second playing piece 22 onto the playing piece mount 30 of the spring-tensioned lever 28, press down on the spring-tensioned lever 28 and release the spring-tensioned lever 28. Releasing the spring-tensioned lever 28 will catapult the first-playing piece 20 or the second playing piece 22 into the air in front of the first launching device 24 or the second launching device 26.

Figure 6:
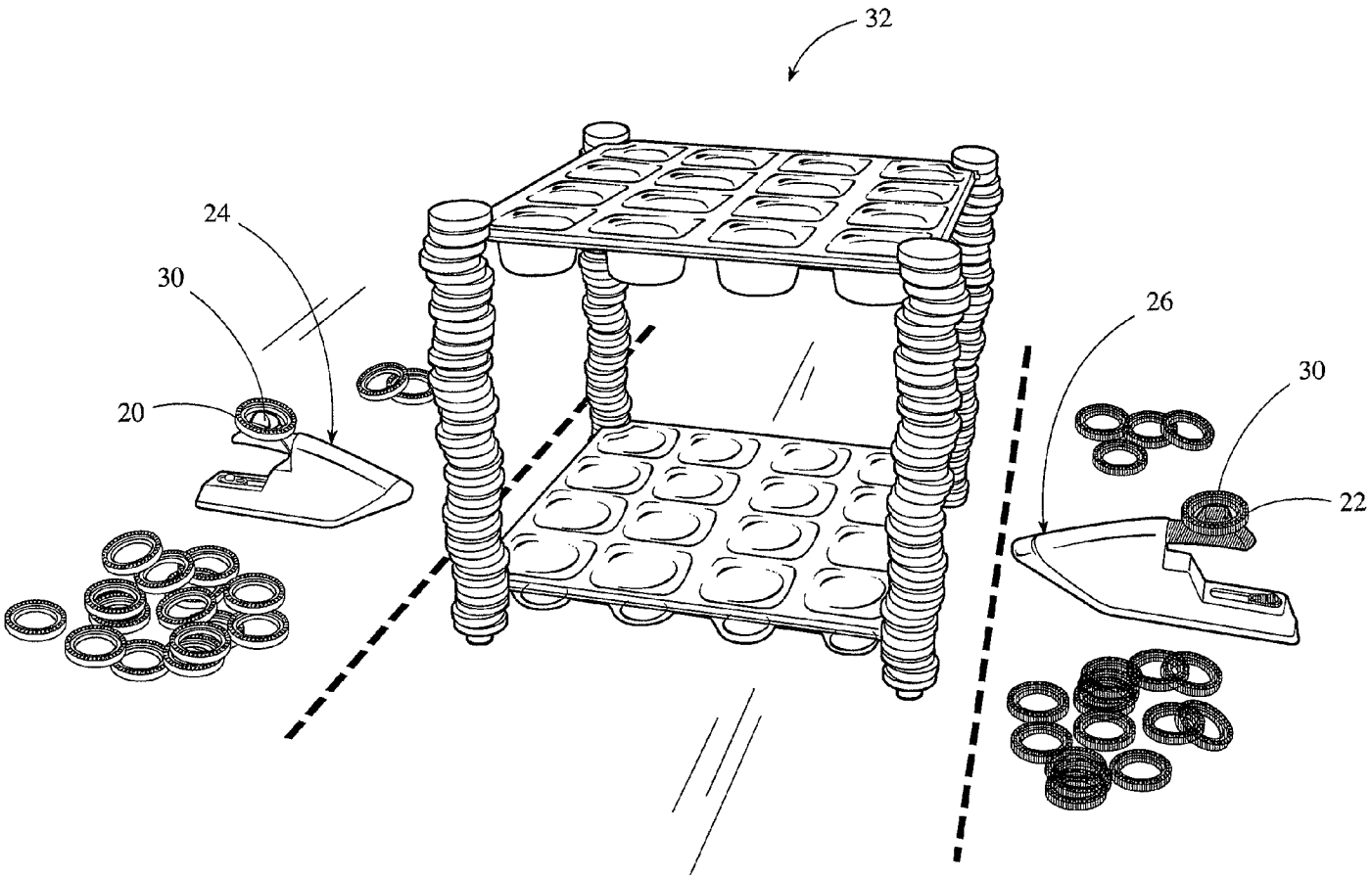
FIG. 6 shows an assembled game board, first and second playing pieces and first and second launching devices arranged for the start of a game.

FIG. 6 shows a fully assembled game assembly 32 of the described embodiments, a set of first playing pieces 20, a set of second playing pieces 22, the first launching device 24 and the second launching device 26 arranged for the beginning of game play. The fully assembled game assembly 32 is placed equidistant between a first player game boundary 34 and a second player game boundary 36. The set of first playing pieces 20 and the first launching device 24 are placed outside the first player game boundary 34 relative to the fully assembled game assembly 32. The set of second playing pieces 22 and the second launching device 26 are placed outside the second player game boundary 36 relative to the fully assembled game assembly 32. As shown in FIG. 6, a first playing piece 20 is placed on the playing piece mount 30 of the first launching device 24 and is ready to be launched when a game begins, and a second playing piece 22 is placed on the playing piece mount 30 of the second launching device 26 and is also ready to be launched when a game begins.

Figure 7A:
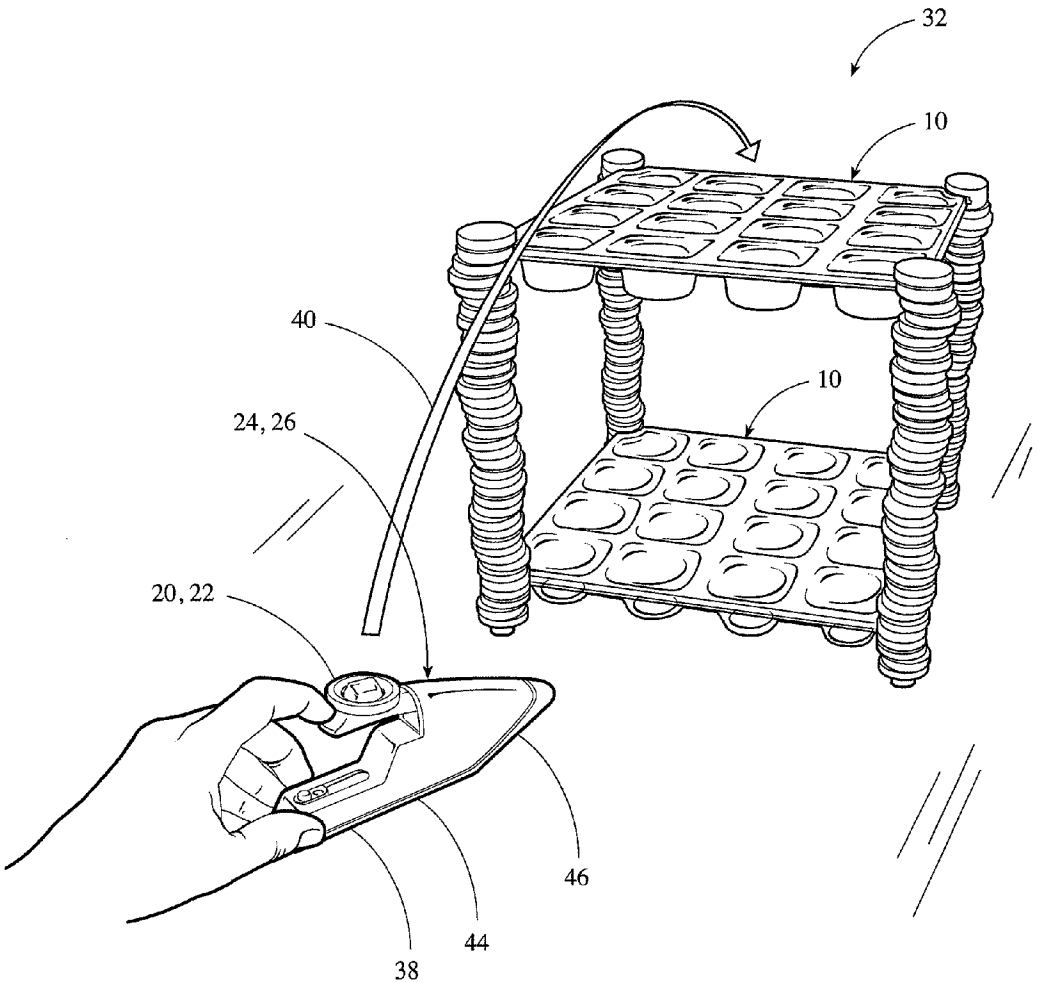
FIG. 7A and FIG. 7B show how the launching devices can be positioned to launch a playing piece into a recessed compartment on a top tray and a bottom tray, respectively.
Figure 7B:
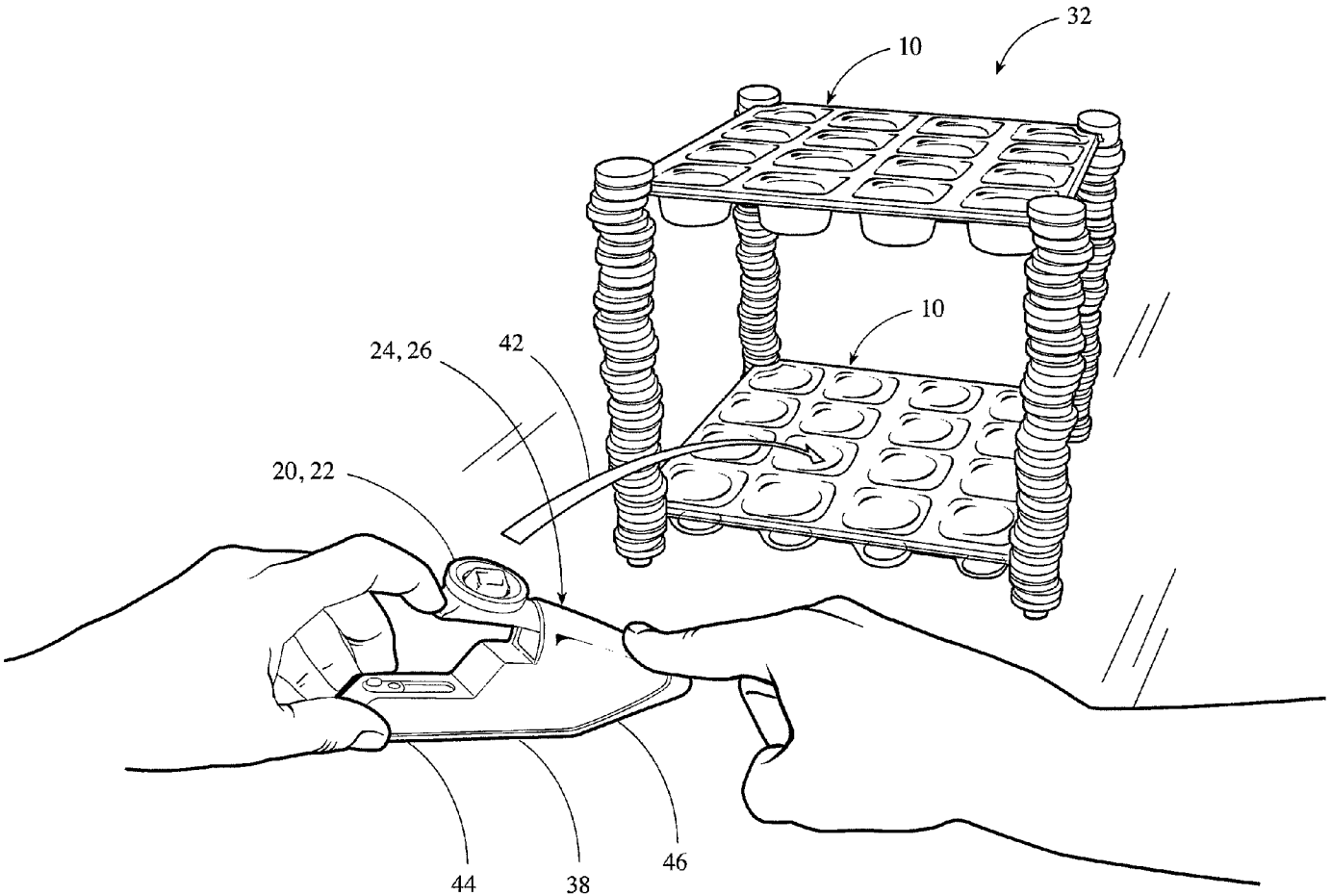

FIG. 7A and FIG. 7B show the fully assembled game assembly 32 in proximity to a launching device that can either be a first launching device 24 or a second launching device 26 where the first launching device 24 or the second launching device 26 is loaded with a first playing piece 20 or a second playing piece 22 ready to be launched. FIG. 7A and FIG. 7B further show the underside of the launching device 38 as a plurality of planar surfaces arranged such that each of said planar surfaces is at an angle to every other of said planar surfaces and wherein first playing pieces 20 and second playing pieces 22 are launched at different angles for each of said planar surfaces placed on a horizontal support surface. FIG. 7A shows one planar surface on the underside of the launching device 38 placed on a horizontal support surface so that when a first playing piece 20 or a second playing piece 22 is launched, the playing piece will follow the high trajectory of the launched playing piece 40 and land in an upper game board tray 10. FIG. 7B shows one planar surface on the underside of the launching device 38 placed on a horizontal support surface so that when a first playing piece 20 or a second playing piece 22 is launched, the playing piece will follow the low trajectory of the a launched playing piece 42 and land in a lower game board tray 10.

The first launching device 24 or the second launching device 26 as shown in FIG. 7A and FIG. 7B shows a first planar surface 44 and a second planar surface 46 on the underside of the launching device 38. FIG. 7A shows that when tension is placed on the first launching device 24 or the second launching device 26 by a player's hand so that the first planar surface 44 rests on a horizontal support surface, the result of a launched playing piece is the high trajectory of a launched playing piece 40. FIG. 7B shows that when tension is placed on the first launching device 24 or the second launching device 26 by a player's hand so that the second planar surface 46 rests on a horizontal support surface, the result of a launched playing piece is the low trajectory of a launched playing piece 42.

Figure 8A:
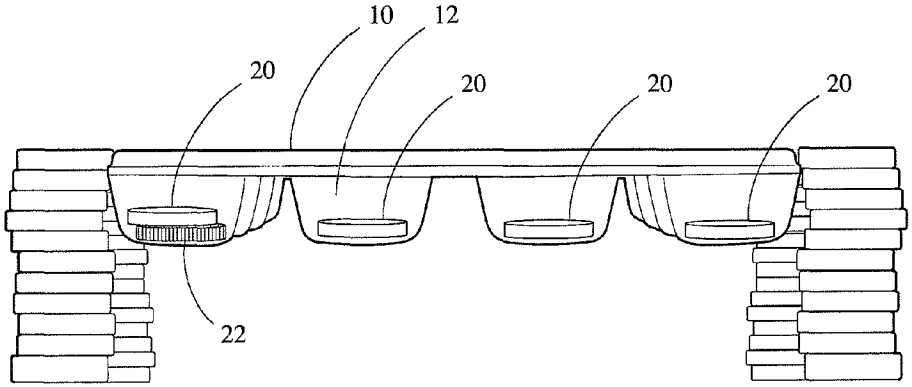
FIG. 8A and FIG. 8B show side elevation views of the game board tray where the types of playing pieces and the number of each type of playing pieces in the recessed compartments can be observed.
Figure 8B:
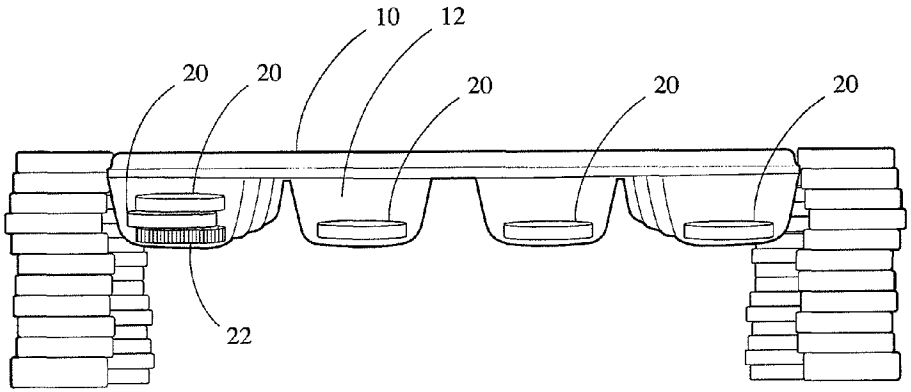

FIG. 8A and FIG. 8B show side elevation views of the recessed compartments 12 of the game board tray 10 containing a combination of first playing pieces 20 and second playing pieces 22. These figures show that the number of first playing pieces 20 and the number of second playing pieces 22 in each recessed compartment 12 and the order in which the first playing pieces 20 and the second playing pieces 22 are stacked within each recessed compartment 12 are observable. As will be discussed below, the ability to view and count the number of first playing pieces 20 and the number of second playing pieces 22 during game play allows for certain varieties of games to be played.

Figure 9C:
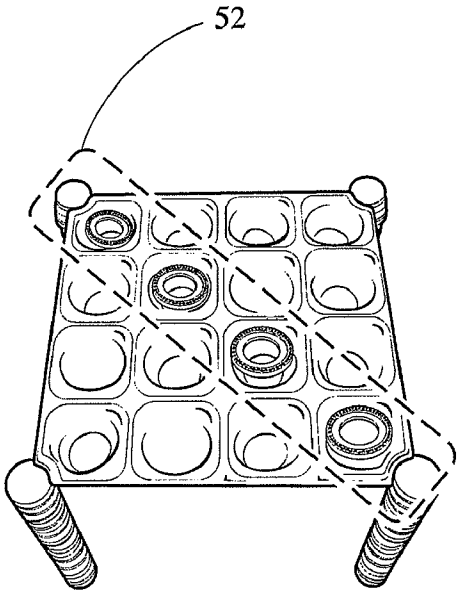
FIG. 9A, FIG. 9B and FIG. 9C show game-winning configurations of four like playing pieces.
Figure 9B:
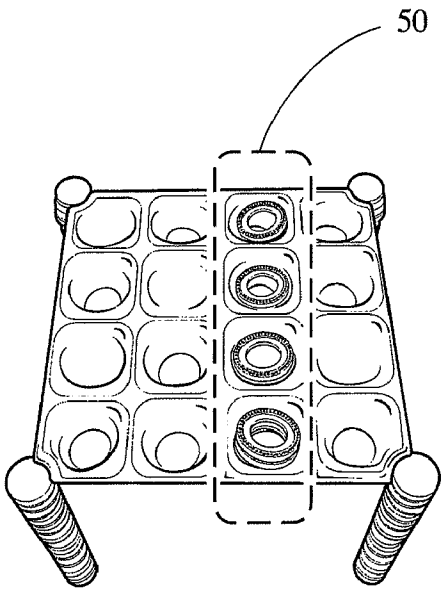
Figure 9A:
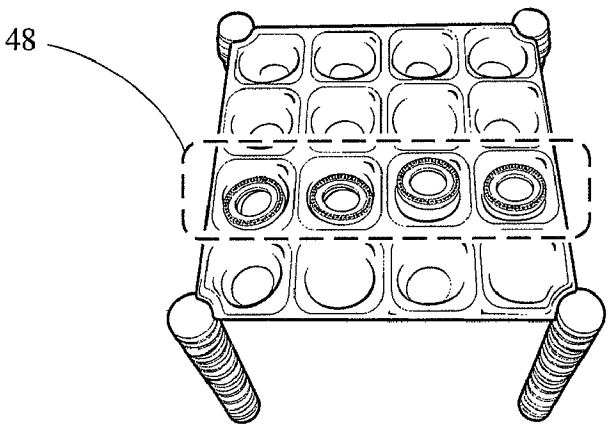

FIG. 9A, FIG. 9B and FIG. 9C show game-winning combinations of four like playing pieces. Each of the combinations in FIG. 9A, FIG. 9B and FIG. 9C show four playing markers in a single row although other combinations of first playing pieces 20 and second playing pieces 22 can represent winning combinations. FIG. 9A shows a widthwise winning combination 48; FIG. 9B shows a lengthwise winning combination 50; and FIG. 9C shows a diagonal winning combination 52.

Figure 10A:
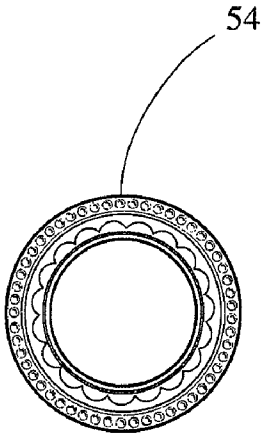
FIG. 10A through FIG. 10D and FIG. 11A through 11D show first playing pieces and second playing pieces, respectively, with indicia that enhance and increase the variety of game play when games are played using an alternating turn format.
Figure 11A:
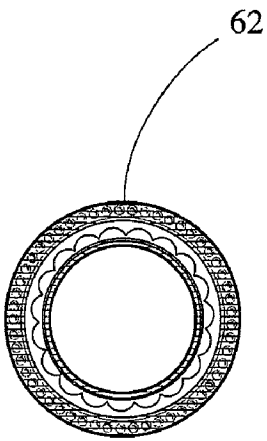

FIG. 10A shows a first playing piece with a first indicia 54 and FIG. 11A shows a second playing piece with a first indicia 62. When a first player launches a first playing piece with a first indicia 54 into a recessed compartment 12 of the game board tray 10 during game play where players use alternating launches, it triggers a first player to launch a first playing piece 20 before a second player launches a second playing piece 22 if the first player has, in the most recent launch, launched a first playing piece with the first indicia 54 into a recessed compartment 12. When a second player launches a second playing piece with a first indicia 62 into a recessed compartment 12 of the game board tray 10 during game play where players use alternating launches, it triggers a second player to launch a second playing piece 22 before a first player launches a first playing piece 20 if the second player has, in the most recent launch, launched a second playing piece with the first indicia 62 into a recessed compartment 12. In other words, the first playing piece with a first indicia 54 lets the first player take another turn and the second playing piece with a first indicia 62 lets the second player take another turn in games with alternating turns.

Figure 10B:
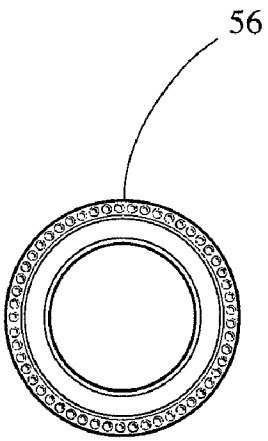
Figure 11B:
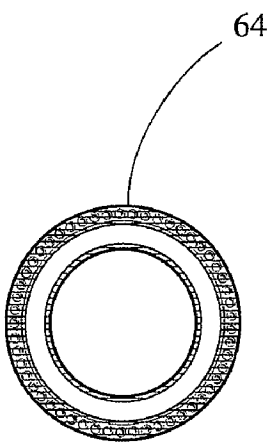

FIG. 10B shows a first playing piece with a second indicia 56 and FIG. 11B shows a second playing piece with a second indicia 64. When a first player launches a first playing piece with a second indicia 56 into a recessed compartment 12 of the game board tray 10 during game play where players use alternating launches, it triggers a first player to remove all first playing pieces 20 and all second playing pieces 22 from all recessed compartments 12 adjacent to the recessed compartment 12 holding the first playing piece with the second indicia 56 if the first playing piece with the second indicia 56 was the playing piece most recently launched. When a second player launches a second playing piece with a second indicia 64 into a recessed compartment 12 of the game board tray 10 during game play where players use alternating launches, it triggers a second player to remove all first playing pieces 20 and all second playing pieces 22 from all recessed compartments 12 adjacent to the recessed compartment 12 holding the second playing piece with the second indicia 64 if the second playing piece with the second indicia 64 was the playing piece most recently launched. In other words, when a first playing piece with a second indicia 56 or a second playing piece with a second indicia 64 lands in a recessed compartment 12 during games played with alternating launches, the player that launched the playing pieces empties all adjacent recessed compartments 12 before the next player takes a turn.

Figure 12B:
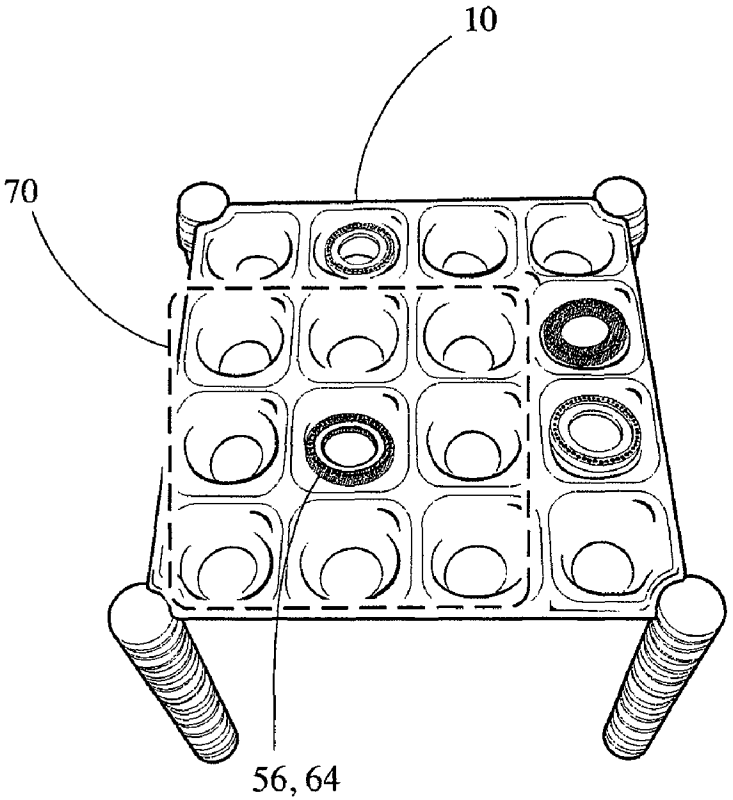
FIG. 12A and FIG. 12B show the effect of launching a playing piece into a recessed compartment with an indicia that triggers a player to remove all playing pieces from all adjacent recessed compartments.
Figure 12A:
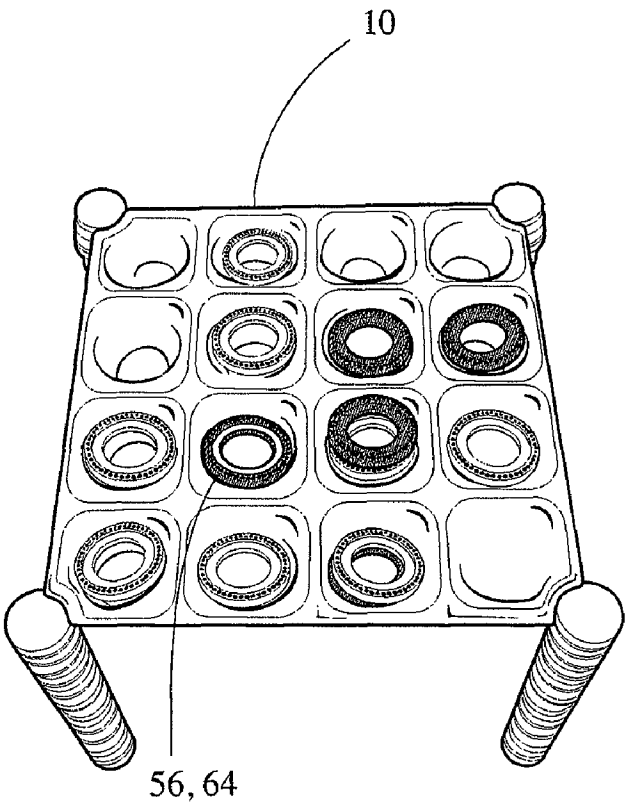

FIG. 12A shows a first playing piece with a second indicia 56 or a second playing piece with a second indicia 64 launched into the third row down from and the second column to the right of the upper left-hand corner of the game board tray 10. FIG. 12B shows the effect of a first playing piece with a second indicia 56 or a second playing piece with a second indicia 64 that was launched into the third row down from and the second column to the right of the upper left-hand corner of the game board tray 10. The dashed outline line in FIG. 12B shows the boundary of the area with all adjacent spaces cleared 70.

Figure 10C:
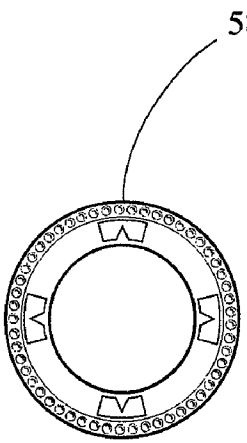
Figure 11C:
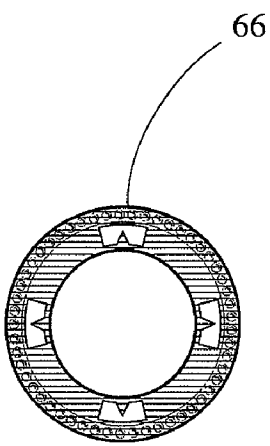

FIG. 10C shows a first playing piece with a third indicia 58 and FIG. 11C shows a second playing piece with a third indicia 66. When a first player launches a first playing piece with a third indicia 58 into a recessed compartment 12 of the game board tray 10 during game play where players use alternating launches, it triggers a first player to remove all first playing pieces 20 and all second playing pieces 22 from all other recessed compartments 12 in one of either a row and a column containing the first playing piece with the third indicia 58 if the first playing piece with the third indicia 58 was the playing piece most recently launched. When a second player launches a second playing piece with a third indicia 66 into a recessed compartment 12 of the game board tray 10 during game play where players use alternating launches, it triggers a second player to remove all first playing pieces 20 and all second playing pieces 22 from all other recessed compartments 12 in one of either a row and a column containing the second playing piece with the third indicia 66 if the second playing piece with the third indicia 66 was the playing piece most recently launched. In other words, when a first playing piece with a third indicia 58 or a second playing piece with a third indicia 66 lands in a recessed compartment 12 during games played with alternating launches, the player that launched the playing pieces empties all other recessed compartments 12 in either a row or a column containing a first playing piece with a third indicia 58 or a second playing piece with a third indicia 66 before the next player takes a turn.

Figure 13C:
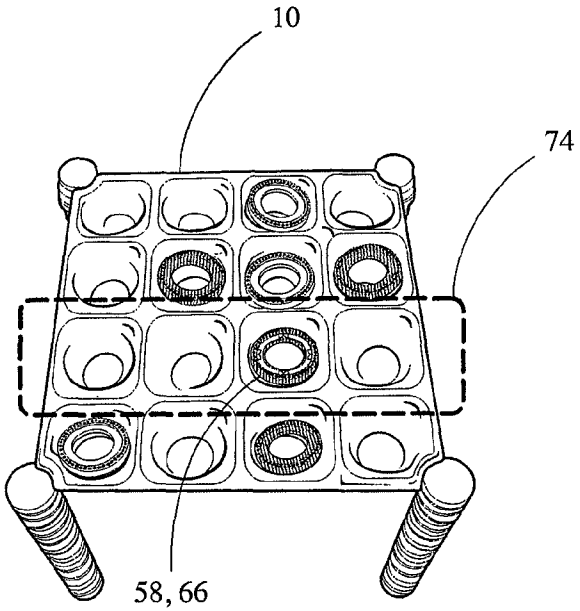
FIG. 13A, FIG. 13B and FIG. 13C show the effect of launching a playing piece into a recessed compartment with an indicia that triggers a player to remove all playing pieces from all other recessed compartments in either the row or the column containing the launched playing piece with the indicia.
Figure 13B:
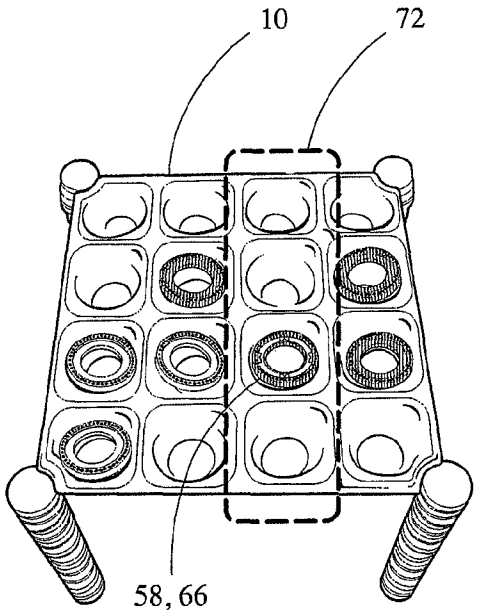
Figure 13A:
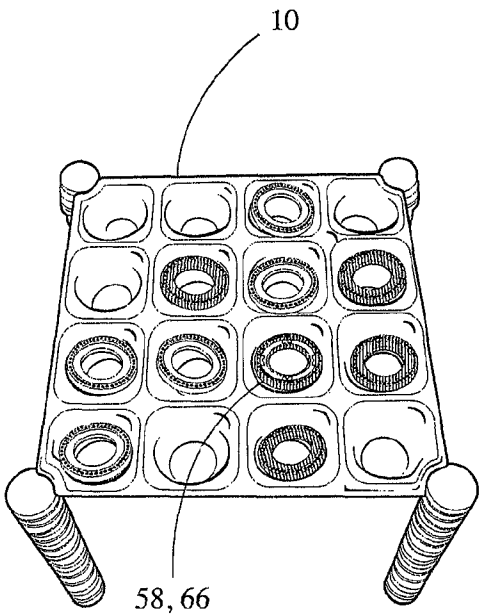

FIG. 13A shows a first playing piece with a third indicia 58 or a second playing piece with a third indicia 66 launched into the third row down from and the third column to the right of the upper left-hand corner of the game board tray 10. FIG.

13B and FIG. 13C show the effects of a first playing piece with a third indicia 58 or a second playing piece with a third indicia 66 that was launched into the third row down from and the third column to the right of the upper left-hand corner of the game board tray 10. The player who launched the first playing piece with a third indicia 58 or the second playing piece with a third indicia 66 has a choice of whether to clear all other recessed compartments 12 in either a row or a column containing the playing piece. The dashed outline line in FIG. 13B shows the boundary of the area with a column cleared 72. The dashed outline line in FIG. 13C shows the boundary of the area with a row cleared 74.

Figure 10D:
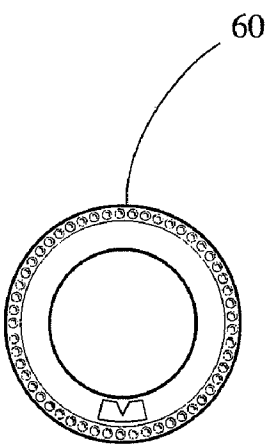
Figure 11D:
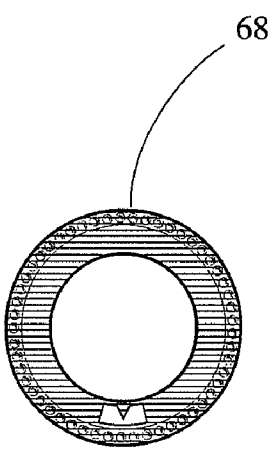

FIG. 10D shows a first playing piece with a fourth indicia 60 and FIG. 11D shows a second playing piece with a fourth indicia 68. When a first player launches a first playing piece with a fourth indicia 60 into a recessed compartment 12 of the game board tray 10 during game play where players use alternating launches, it triggers a first player to remove all first playing pieces 20 and all second playing pieces 22 from any one recessed compartment 12 adjacent to the recessed compartment 12 containing the first playing piece with the fourth indicia 60 if the first playing piece with the fourth indicia 60 was the playing piece most recently launched. When a second player launches a second playing piece with a fourth indicia 68 into a recessed compartment 12 of the game board tray 10 during game play where players use alternating launches, it triggers a second player to remove all first playing pieces 20 and all second playing pieces 22 from any one recessed compartment 12 adjacent to the recessed compartment 12 containing the second playing piece with the fourth indicia 68 if the second playing piece with the fourth indicia 68 was the playing piece most recently launched. In other words, when a first playing piece with a fourth indicia 60 or a second playing piece with a second indicia 68 lands in a recessed compartment 12 during games played with alternating launches, the player that launched the playing pieces empties one adjacent recessed compartment 12 before the next player takes a turn.

Figure 14B:
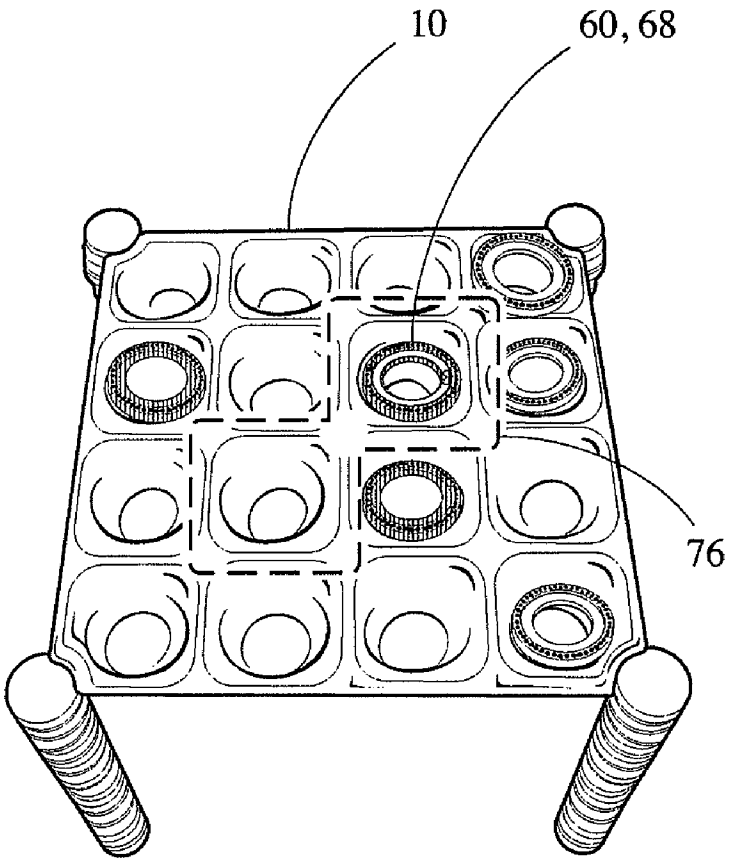
FIG. 14A and FIG. 14B show the effect of launching a playing piece into a recessed compartment with an indicia that triggers a player to remove all playing pieces from one adjacent recessed compartment.
Figure 14A:
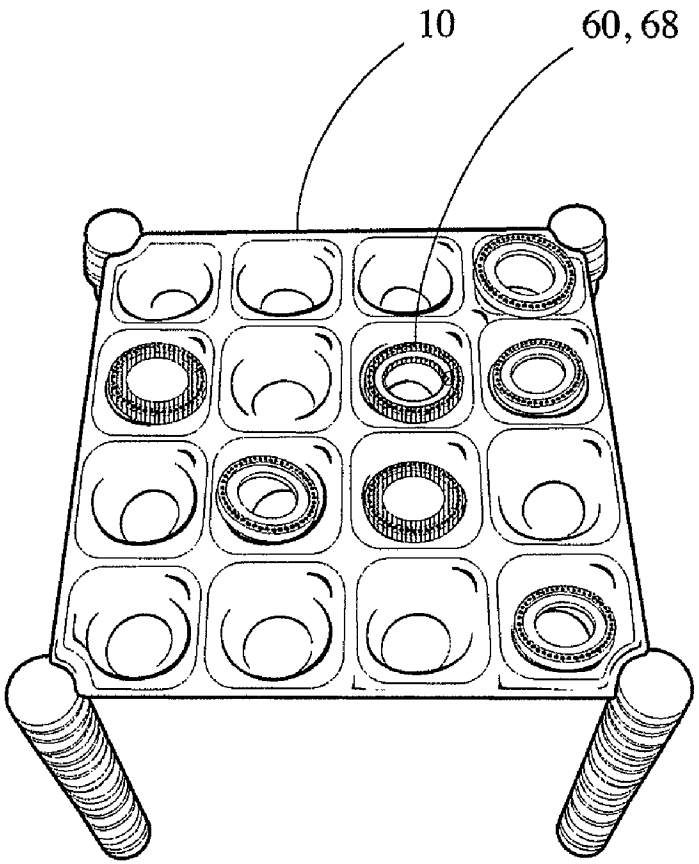

FIG. 14A shows a first playing piece with a fourth indicia 60 or a second playing piece with a second indicia 68 launched into the second row down from and the third column to the right of the upper left-hand corner of the game board tray 10. FIG. 14B shows the effect of a first playing piece with a fourth indicia 60 or a second playing piece with a fourth indicia 68 that was launched into the second row down from and the third column to the right of the upper left-hand corner of the game board tray 10. The dashed outline line in FIG. 14B shows the boundary of the area with one adjacent space cleared 76.

In the described embodiments, the following described games are for two to four players ages five and older. The contents of the game include twenty-one first playing pieces 20, twenty-one second playing pieces 22, four vertical support columns 16, two game board trays 10, one first launching device 24 and one second launching device 26. In the described embodiments, the first playing pieces 20 and the first launching device 24 are red, and the second playing pieces 22 and the second launching device 26 are yellow. The first playing pieces 20 and the second playing pieces 22 may also be referred to as checkers. Before a game can begin, the two game board trays 10 and the four vertical support columns 16 are assembled as shown in FIG. 3A, FIG. 3B and FIG. 3C into a fully assembled game assembly 32 as shown in FIG. 6. Then the first playing pieces 20 and the first launching device 24 are placed on one side of the fully assembled game assembly 32 and the second playing pieces 22 and the second launching device 26 are placed on the other side of the fully assembled game assembly 32 as shown in FIG. 6. The various playing pieces with the indicia that were described earlier are included with the twenty-one playing pieces given to each player. Game play is then ready to begin.

In a first described game, which may be called "Basic Frantic Launch" and will be described using two players, one player yells, "ready, set, launch" and both players begin to simultaneously launch their respective playing pieces toward the fully assembled game assembly 32, trying to land their respective playing pieces in the recessed compartments 12. The players should launch their playing pieces as fast as possible. The first player to land four of their own playing pieces in a row as shown in FIG. 9A, FIG. 9B or FIG. 9C shouts "CONNECT FOUR" and both players must then stop launching playing pieces. The player who has landed four of his or her own playing pieces in a row wins the game. For this described game in the described embodiments, the recessed compartments 12 can hold multiple playing pieces, and the playing piece on the top is the one that counts. In order to win the game, a player may get four in a row in either the top game board tray 10 or the bottom game board tray 10. If both players have launched all their playing pieces and neither player has landed four in a row, there is a rematch.

In a second described game, which may be called "Championship Frantic Launch" and will be described using two players, the game is played in rounds where each round is played as in the game described as "Basic Frantic Launch". Points are awarded to each player who lands four playing pieces in a row as shown in FIG. 9A, FIG. 9B or FIG. 9C. If a player lands four in a row, the playing round ends. If a player lands four in a row in the top game board tray 10, that player gets two points. If a player lands four in a row in the bottom game board tray 10, that player gets one point. Described embodiments may have a scoring tab built into the launching device that can be moved each time a player scores points to mark that player's score. In this game, a playing round also ends if both players have launched all their playing pieces and neither player has landed four in a row. If this happens, neither player scores any points. At the end of each round, the players gather all their playing pieces and set up to begin the next round. To start a new round, the recessed compartments 12 are cleared, each player gathers his or her playing pieces, and the players set up as shown in FIG. 6. The game ends when one player scores five points.

A third described game may be called "Advanced Power Launch". This game may be played with any or all of the playing pieces described with references to FIG. 10A through FIG. 10D, FIG. 11A through FIG. 11D, FIG. 12A and FIG. 12B, FIG. 13A through FIG. 13C, and FIG. 14A and FIG. 14B. This game is played with players taking alternating turns launching playing pieces into the recessed compartments 12. The youngest player launches first. As in the earlier described games, a playing round ends when one player gets four playing pieces in a row in the recessed compartments 12 or when both players run out of his or her playing pieces. In this described game, the basic object is still for one player to land four playing pieces in a row, however, the player with the most playing pieces in a recessed compartment 12 controls that recessed compartment. For example, referring to FIG. 8A, all four recessed compartments 12 shown have one first playing piece 20 and the recessed compartment 12 furthest to the left also has one second playing piece 22. Under the rules of this game, because there are equal numbers of first playing pieces 20 and second playing pieces 22 in the recessed compartment 12, the effect is the same as if the recessed compartment was empty. In FIG. 8B the recessed compartment 12 furthest to the left has two first playing pieces 20 and only one second playing piece 22; thus, the recessed compartment 12 is controlled by the first player. Consequently, because the other recessed compartments 12 in the row have a first playing piece 20, the first player has scored. In this described game, a player scores two points for landing four in a row in the upper game board tray 10 and one point for landing four in a row in the lower game board tray 10. To start a new round, the recessed compartments 12 are cleared, each player gathers his or her playing pieces, and the players set up as shown in FIG. 6.

The following rules apply to all of the above-described games. If a playing piece completely misses the game board trays 10, it can be launched again during a round or during a single-round game. If one player has launched all of his or her playing pieces, the other player can still launch his or her playing pieces during the round or the single-round game if no player has landed four in a row. If one player shouts, "Connect Four" while a playing piece from another player is in the air and if that airborne playing piece negates the four in a row, nobody has won and the game continues. If a playing piece lands on the game board tray 10 and not in a recessed compartment 12, it remains in place until a round or a game ends. If playing pieces with the previously described first indicia, second indicia, third indicia or fourth indicia land in a recessed compartment 12, it counts as one of four in a row and in all other respects behaves as a regular playing piece. The above-described games can also be played with more than one player on a team. Games with multiple players per team are played the same as previously described except that the launching devices are passed from player to player between turns.

Some of the special features of the above-described games as used in the described embodiments are highlighted in the above descriptions. Notably, a few of these features are that the stacking of the various playing pieces in the recessed compartments 12 allows for a dynamically changing game layout on the game board trays 10, action packed versions can be played of traditionally strategy-focused games, and elements of sporting competition are added to a board game.

While the present inventions have been illustrated by a description of various embodiments and while these embodiments have been set forth in considerable detail, it is intended that the scope of the inventions be defined by the appended claims. It will be appreciated by those skilled in the art that modifications to the foregoing preferred embodiments may be made in various aspects. It is deemed that the spirit and scope of the inventions encompass such variations to be preferred embodiments as would be apparent to one of ordinary skill in the art and familiar with the teachings of the present application.

What is claimed is:

1. A game apparatus comprising:

a first tray;

a vertical support column attached to the first tray and supporting the first tray horizontally above a support surface;

a set of first playing pieces;

a set of second playing pieces distinguishable from the first set of playing pieces;

a matrix on the surface of the first tray wherein each element of the matrix comprises a recessed compartment orthogonal to the surface of the tray and wherein each recessed compartment is sized to hold a multiplicity of first playing pieces and a multiplicity of second playing pieces simultaneously in a stacked manner;

a first launching device for launching first playing pieces into the recessed compartments; and a second launching device for launching second playing pieces into the recessed compartments, wherein the first launching device further comprises a plurality of planar surfaces on the underside of the first launching device arranged such that each of said planar surfaces is at an angle to every other of said planar surfaces and wherein first playing pieces are launched at different angles for each of said planar surfaces placed on a horizontal support surface and wherein the second launching device further comprises a plurality of planar surfaces on the underside of the second launching device arranged such that each of said planar surfaces is at an angle to every other of said planar surfaces and wherein second playing pieces are launched at different angles for each of said planar surfaces placed on a horizontal support surface.

2. The game apparatus recited in claim 1 further comprising a plurality of vertical support columns attached to the first tray and supporting the first tray horizontally on a support surface.

3. The game apparatus recited in claim 1 further comprising a plurality of trays wherein each tray is attached to the vertical support column and parallel to other trays and wherein each tray comprises a matrix such that each element of each matrix comprises a recessed compartment orthogonal to the surface of the tray and wherein each recessed compartment is sized to hold a multiplicity of first playing pieces and a multiplicity of second playing pieces simultaneously in a stacked manner.

4. The game apparatus recited in claim 3 further comprising a plurality of vertical support columns attached to the plurality of trays and supporting the plurality of trays horizontally on a support surface.

5. The game apparatus recited in claim 1 wherein the number of first playing pieces in each recessed compartment and the number of second playing pieces in each recessed compartment and the order in which said first playing pieces and said second playing pieces are stacked within each recessed compartment is observable.

6. The game apparatus recited in claim 1 further comprising:

a first playing piece with a first indicia that triggers a first player to launch a first playing piece before a second player launches a second playing piece if the first player has, in the most recent launch, launched a first playing piece with the first indicia into a recessed compartment; and a second playing piece with a first indicia that triggers the second player to launch a second playing piece before the first player launches a first playing piece if the second player has, in the most recent launch, launched a second playing piece with the first indicia into a recessed compartment.

7. The game apparatus recited in claim 1 further comprising:

a first playing piece with a second indicia that when launched into a recessed compartment triggers a first player to remove all first playing pieces and all second playing pieces from all recessed compartments adjacent to the recessed compartment holding the first playing piece with the second indicia if the first playing piece with the second indicia was the playing piece most recently launched; and a second playing piece with the second indicia that when launched into a recessed compartment triggers a second player to remove all first playing pieces and all second playing pieces from all recessed compartments adjacent to the recessed compartment holding the second playing piece with the second indicia if the second playing piece with the second indicia was the playing piece most recently launched.

8. The game apparatus recited in claim 1 further comprising:

a first playing piece with a third indicia that when launched into a recessed compartment triggers a first player to remove all first playing pieces and all second playing pieces from all other recessed compartments in one of either a row and a column containing the first playing piece with the third indicia if the first playing piece with the third indicia was the playing piece most recently launched; and a second playing piece with a third indicia that when launched into a recessed compartment triggers a second player to remove all first playing pieces and all second playing pieces from all other recessed compartments in one of either a row and a column containing the second playing piece with the third indicia if the second playing piece with the third indicia was the playing piece most recently launched.

9. The game apparatus recited in claim 1 further comprising:

a first playing piece with a fourth indicia that when launched into a recessed compartment triggers a first player to remove all first playing pieces and all second playing pieces from any one recessed compartment adjacent to the recessed compartment containing the first playing piece with the fourth indicia if the first playing piece with the fourth indicia was the playing piece most recently launched; and a second playing piece with a fourth indicia that when launched into a recessed compartment triggers a second player to remove all first playing pieces and all second playing pieces from any one recessed compartment adjacent to the recessed compartment containing the second playing piece with the fourth indicia if the second playing piece with the fourth indicia was the playing piece most recently launched.

10. The game apparatus recited in claim 1 wherein the plurality of vertical support columns are aligned with the plurality of trays and attached to the plurality of trays in a three dimensional space.

11. A game apparatus comprising:

a plurality of trays;

a plurality of vertical support columns attached to the plurality of trays and supporting the plurality of trays horizontally above a support surface;

a set of first playing pieces;

a set of second playing pieces distinguishable from the first set of playing pieces;

a matrix on the surface of the first tray wherein each element of the matrix comprises a recessed compartment orthogonal to the surface of the tray and wherein each recessed compartment is sized to hold a multiplicity of first playing pieces and a multiplicity of second playing pieces simultaneously in a stacked manner and wherein the number of first playing pieces in each recessed compartment and the number of second playing pieces in each recessed compartment and the order in which said first playing pieces and said second playing pieces are stacked within each recessed compartment is observable;

a first launching device for launching first playing pieces into the recessed compartments wherein the underside of the first launching device comprises a plurality of planar surfaces arranged such that each of said planar surfaces is at an angle to every other of said planar surfaces and wherein first playing pieces are launched at different angles for each of said planar surfaces placed on a horizontal support surface;

a second launching device for launching second playing pieces into the recessed compartments wherein the underside of the second launching device comprises a plurality of planar surfaces arranged such that each of said planar surfaces is at an angle to every other of said planar surfaces and wherein second playing pieces are launched at different angles for each of said planar surfaces placed on a horizontal support surface;

a first playing piece with a first indicia that triggers a first player to launch a first playing piece before a second player launches a second playing piece if the first player has, in the most recent launch, launched a first playing piece with the first indicia into a recessed compartment;

a second playing piece with a first indicia that triggers the second player to launch a second playing piece before the first player launches a first playing piece if the second player has, in the most recent launch, launched a second playing piece with the first indicia into a recessed compartment;

a first playing piece with a second indicia that triggers a first player to remove all first playing pieces and all second playing pieces from all recessed compartments adjacent to the recessed compartment holding the first playing piece with the second indicia if the first playing piece with the second indicia was the playing piece most recently launched;

a second playing piece with the second indicia that triggers a second player to remove all first playing pieces and all second playing pieces from all recessed compartments adjacent to the recessed compartment holding the second playing piece with the second indicia if the second playing piece with the second indicia was the playing piece most recently launched;

a first playing piece with a third indicia that triggers a first player to remove all first playing pieces and all second playing pieces from all recessed compartments in one of either a row and a column containing the first playing piece with the third indicia if the first playing piece with the third indicia was the playing piece most recently launched;

a second playing piece with the third indicia that triggers a second player to remove all first playing pieces and all second playing pieces from all recessed compartments in one of either a row and a column containing the second playing piece with the third indicia if the second playing piece with the third indicia was the playing piece most recently launched;

a first playing piece with a fourth indicia that triggers a first player to remove all first playing pieces and all second playing pieces from any one recessed compartment adjacent to the recessed compartment containing the first playing piece with the fourth indicia if the first playing piece with the fourth indicia was the playing piece most recently launched; and a second playing piece with a fourth indicia that triggers a second player to remove all first playing pieces and all second playing pieces from any one recessed compartment adjacent to the recessed compartment containing the second playing piece with the fourth indicia if the second playing piece with the fourth indicia was the playing piece most recently launched.

12. The game apparatus recited in claim 11 wherein the plurality of vertical support columns are aligned with the plurality of trays and attached to the plurality of trays in a three dimensional space.

13. A game apparatus comprising:

a plurality of trays;

a plurality of vertical support columns attached to the plurality of trays and supporting the plurality of trays horizontally above a support surface;

a set of first playing pieces;

a set of second playing pieces distinguishable from the first set of playing pieces;

a matrix on the surface of the first tray wherein each element of the matrix comprises a recessed compartment orthogonal to the surface of the tray and wherein each recessed compartment is sized to hold a multiplicity of first playing pieces and a multiplicity of second playing pieces simultaneously in a stacked manner and wherein the number of first playing pieces in each recessed compartment and the number of second playing pieces in each recessed compartment and the order in which said first playing pieces and said second playing pieces are stacked within each recessed compartment is observable;

a first launching device for launching first playing pieces into the recessed compartments, wherein the first launching device further comprises a plurality of planar surfaces on the underside thereof and wherein first playing pieces are launched at different angles for each of said planar surfaces placed on a horizontal support surface; and a second launching device for launching second playing pieces into the recessed compartments wherein the second launching device further comprises a plurality of planar surfaces on the underside thereof and wherein second playing pieces are launched at different angles for each of said planar surfaces placed on a horizontal support surface.

14. The game apparatus recited in claim 13 further comprising:

a first playing piece with a first indicia that triggers a first player to launch a first playing piece before a second player launches a second playing piece if the first player has, in the most recent launch, launched a first playing piece with the first indicia into a recessed compartment; and a second playing piece with a first indicia that triggers the second player to launch a second playing piece before the first player launches a first playing piece if the second player has, in the most recent launch, launched a second playing piece with the first indicia into a recessed compartment.

15. The game apparatus recited in claim 13 further comprising:

a first playing piece with a second indicia that when launched into a recessed compartment triggers a first player to remove all first playing pieces and all second playing pieces from all recessed compartments adjacent to the recessed compartment holding the first playing piece with the second indicia if the first playing piece with the second indicia was the playing piece most recently launched; and a second playing piece with the second indicia that when launched into a recessed compartment triggers a second player to remove all first playing pieces and all second playing pieces from all recessed compartments adjacent to the recessed compartment holding the second playing piece with the second indicia if the second playing piece with the second indicia was the playing piece most recently launched.

16. The game apparatus recited in claim 13 further comprising:

a first playing piece with a third indicia that when launched into a recessed compartment triggers a first player to remove all first playing pieces and all second playing pieces from all other recessed compartments in one of either a row and a column containing the first playing piece with the third indicia if the first playing piece with the third indicia was the playing piece most recently launched; and a second playing piece with a third indicia that when launched into a recessed compartment triggers a second player to remove all first playing pieces and all second playing pieces from all other recessed compartments in one of either a row and a column containing the second playing piece with the third indicia if the second playing piece with the third indicia was the playing piece most recently launched.

17. The game apparatus recited in claim 13 further comprising:

a first playing piece with a fourth indicia that when launched into a recessed compartment triggers a first player to remove all first playing pieces and all second playing pieces from any one recessed compartment adjacent to the recessed compartment containing the first playing piece with the fourth indicia if the first playing piece with the fourth indicia was the playing piece most recently launched; and a second playing piece with a fourth indicia that when launched into a recessed compartment triggers a second player to remove all first playing pieces and all second playing pieces from any one recessed compartment adjacent to the recessed compartment containing the second playing piece with the fourth indicia if the second playing piece with the fourth indicia was the playing piece most recently launched.

18. The game apparatus recited in claim 13 wherein the plurality of planar surfaces on the underside of the first launching device are arranged with each said planar surface at an angle and first playing pieces are launched at different angles for each of said planar surfaces placed on a horizontal support surface.

19. The game apparatus recited in claim 18 wherein the plurality of planar surfaces on the underside of the first launching device are arranged with each said planar surface at an angle to the others of said plurality of planar surfaces and first playing pieces are launched at different angles for each of said planar surfaces placed on a horizontal support surface, and wherein the second launching device further comprises a plurality of planar surfaces on the underside of the second launching device arranged such that each of said planar surfaces is at an angle to every other of said planar surfaces and wherein second playing pieces are launched at different angles for each of said planar surfaces placed on a horizontal support surface.

20. The game apparatus recited in claim 13 wherein the plurality of vertical support columns are aligned with the plurality of trays and attached to the plurality of trays in a three dimensional space.

* * * * *